United States Patent [19]

Anderson et al.

[11] 4,224,974

[45] Sep. 30, 1980

[54] MOUNTING BRACKET FOR VENETIAN BLIND ASSEMBLY

[75] Inventors: James M. Anderson; Samuel J. Anderson, both of Swarthmore, Pa.

[73] Assignee: International Blind Company, Chester, Pa.

[21] Appl. No.: 969,093

[22] Filed: Dec. 13, 1978

Related U.S. Application Data

[62] Division of Ser. No. 798,649, May 19, 1977, Pat. No. 4,177,853.

[51] Int. Cl.[3] ..... E06B 9/38

[52] U.S. Cl. ..... 160/178 R; 248/221.4

[58] Field of Search ..... 160/345, 178 R; 248/251-270, 221.4

[56] References Cited

U.S. PATENT DOCUMENTS 3,129,751 4/1964 Weber ..... 160/345

*Primary Examiner*—Peter M. Caun

*Attorney, Agent, or Firm*—Eugene E. Renz, Jr.

[57] ABSTRACT

A bracket for mounting the head rail of a venetian blind to a support surface of a window opening. The head rail is in the form of channel member of U-shaped cross section comprising a base member pivotally mounted to a support surface, a pair of flexible, resilient legs depending from the base member having tangs at their terminal ends engageable with locking beads running the length of the head rail channel and rotatable to a position wherein the tangs release the channel member.

7 Claims, 14 Drawing Figures

62
64
40
12
62a
78
31
78
66
46
48
II
32
20
76
34
102
100
62a
62
64
42
28
28
34
24
28a
I
28b
B
26
28
24
28
24
128
128
122
127
127
29
29
22

22
128

128
127
124
126
131
129
120
127
122
126
133
130

MOUNTING BRACKET FOR VENETIAN BLIND ASSEMBLY

This application is a division of our co-pending application Ser. No. 798,649 filed May 19, 1977 now U.S. Pat. No. 4,177,853, entitled VENETIAN BLIND ASSEMBLY AND MOUNTING MEANS THEREFOR.

BACKGROUND OF THE INVENTION

The present invention relates generally to venetian blinds and more specifically to a novel mounting bracket for the head rail of the blind assembly characterized by novel features of construction and arrangement facilitating accurate and easy assembly and disassembly of the blinds in a window opening or the like. The present invention also contemplates and is directed to a novel mounting arrangement for suspending a venetian blind in a double pane window assembly. Still another feature of the present invention is the provision of novel slat ladder and tilt control bar combination insuring closing of all the slats to the same angular attitude when the slats are actuated to extreme limit positions thereby providing optimum light shielding characteristics. The slat ladder and tilt control bar arrangement incorporates a slip feature permitting rotation of the tilt bar relative to the ladder at the extreme limit positions to minimize wear and damage.

The venetian blind assembly of the present invention also incorporates novel means accurately positioning the blind assembly in a predetermined centered position in the window opening including bumper or stop means preventing lateral displacement of the head rail upon acutation of the lift cord to raise and lower the blind.

Conventional venetian blinds usually include a head rail supported on brackets or the like in the upper section of a window opening, a bottom rail and a plurality of horizontally disposed slats supported in ladder strings or tapes suspended from the head rail and secured to the bottom rail. The assembly further includes a rotatable tilt control rod connected to the ladder or tape to change the angular attitude of the slats and a separate actuator for raising and lowering the blind.

The typical head rail assembly of conventional prior known venetian blinds usually consists of an elongated channel member of U-shaped cross section supported by brackets adjacent the top of a window. There are many bracket configurations and the precise type is dictated by the configuration of the structure defining the window opening. The particular design may dictate a side, top or front wall mounting. The brackets for each type installation are usually supplied in pairs of differing configuration, one for each end of the head rail. This obviously is a disadvantage to a supplier by reason of having to store a large quantity of hardware.

Presently known mounting arrangements for double pane window installations are also complicated construction and usually require a tool to detach the head rail after once installed.

Another problem inherent in double pane venetian blind installations is the lateral displacement of the head rail assembly in the brackets resulting from a thrust force induced by the actuating system for raising and lowering the blind. This displacement is obviously undesirable since it tends to off center the blind relative to the sash and therefore is somewhat esthetically awkward. In some instances, lateral displacement jams the bottom of the blind against the side wall of the window casement with the result that the slats assume a cocked position correctable only by disassembling the sash which is time consuming and annoying. Displacement of the head rail often results in wear and abrasion due to contact of the blind slats on the window.

SUMMARY OF THE INVENTION

With the above in mind, it is an object of the present invention to provide a bracket of box-like configuration characterized by novel features of construction and arrangement suited for application to the top, side or vertical front wall of a window opening which is adapted to firmly support the head rail in place. The bracket may be termed universal since it is suited for mounting at either end of the head rail. The universal bracket of the present invention is also designed to allow for slight variations in the window opening lateral dimensions and in combination with the lateral stop adjustment mechanism of the present invention insures accurate positioning of the blind in the window opening.

A still further object of the present invention is to provide a simple and unique pivotally mounted bracket including flexible, resilient locking means for supporting the head and capable of being pivoted manually to release the head rail.

Still another object of the present invention is to provide a novel tilt control rod and ladder assembly which insures complete closing of all the slats in either extreme limit position and incorporates an override or slip feature protecting the ladder string against damage even when the tilt control rod is rotated with the slats in either extreme limit position.

BRIEF DESCRIPTION OF THE DRAWINGS

The above and other objects of the present invention and various features and details of the operation and construction of a venetian blind assembly in accordance with the present invention are hereinafter more fully set forth with reference to the accompanying drawings, wherein.

Figure 1:
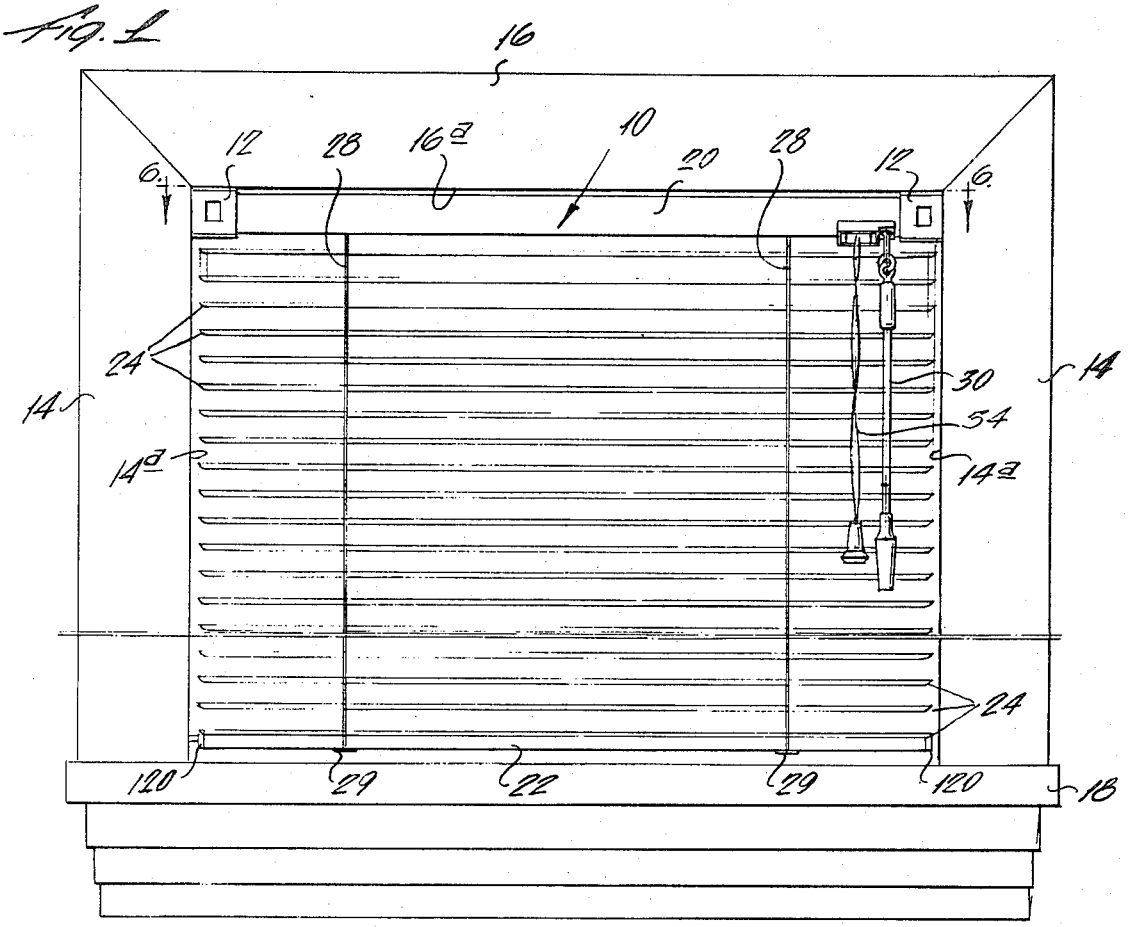
FIG. 1 is a front elevational view of a venetian blind assembly constructed in accordance with the present invention mounted in a conventional window opening.
Figure 3:
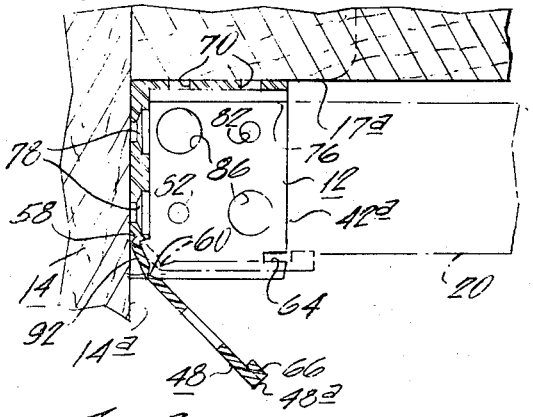
FIG. 3 is a sectional view taken on lines 3—3 of FIG. 2.

Referring now to the drawings and particularly the FIGS. 1-5 thereof, there is illustrated a venetian blind assembly generally designated by the numeral 10 supported in a window opening or the like on universal mounting brackets 12 constructed in accordance with the present invention. The casement for the window sash (not shown) comprises vertical upstanding side frame elements 14, 14, a horizontal top frame element 16 and a lower frame element or sill 18. The confronting spaced side faces 14*a* of the vertical side frame elements 14 provide mounting surfaces for the head rail brackets 12. The lower face of the horizontal frame element 16 also define mounting surfaces 16*a*. The casement may also include a recessed ledge which in some installations provides still another mounting surface 17*a* for the brackets 12.

As will be clear from the following description, the universal mounting bracket may be mounted on any of these surfaces at either end of the head rail and with a common fastener thus minimizing bracket and inventory requirements. Further the head rail firmly rests in the mounted bracket without fasteners thus simplifying assembly of the blind and effecting a still further economy. The bracket 12 is preferably formed of a semi-rigid plastic material for example polypropelene and may be molded to finished form by conventional techniques.

Figure 8:
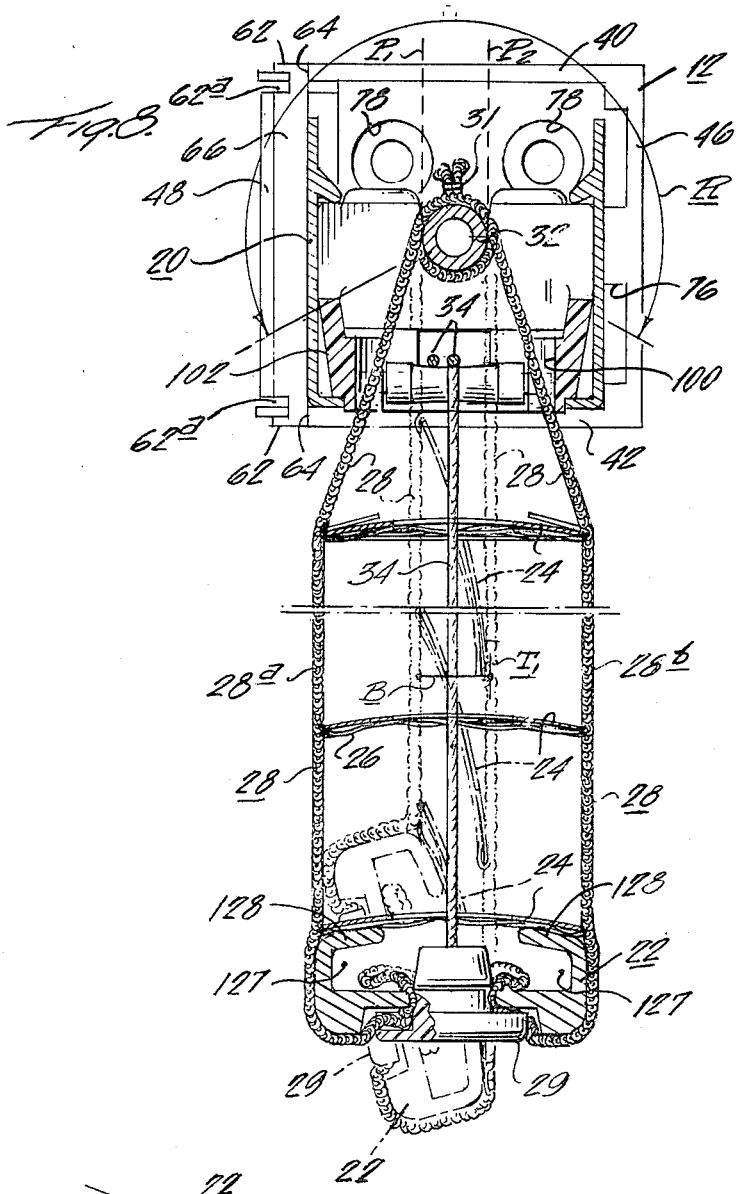
FIG. 8 is a sectional view taken on lines 8—8 of FIG. 7, the broken line position showing the slats in one extreme closed limit position.
Figure 9:
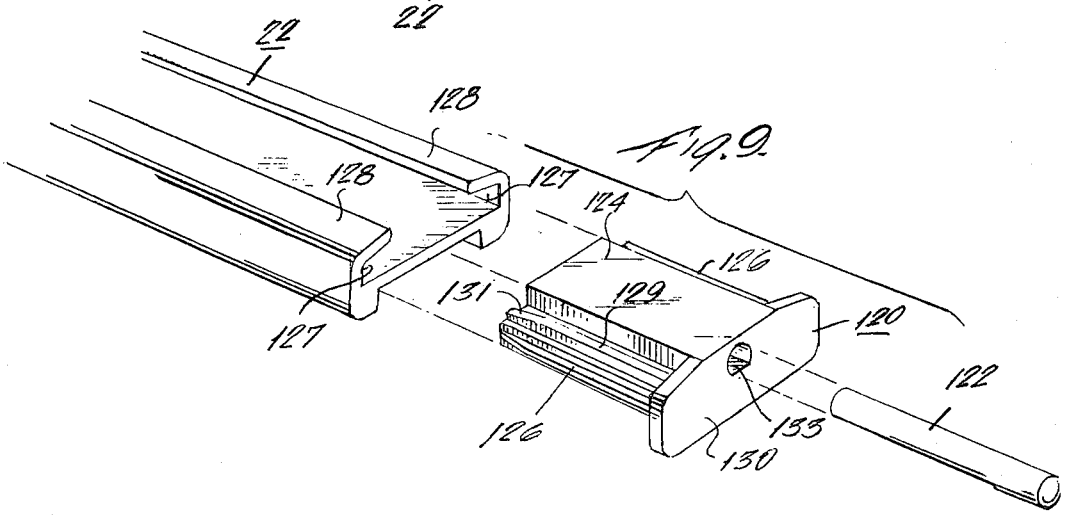
FIG. 9 is an exploded perspective view of the end cap and lateral stop mechanism for the bottom rail of the blind assembly.

The venetian blind assembly comprises broadly a head rail 20, a bottom rail 22, a series of slats 24 supported on rungs 26 of ladder strings 28*a*, 28*b*. A manually operated wand 30 operates a tilt control rod 32 connected to the ladder strings to selectively vary the angular position of the slats in the range indicated by the arc R in FIG. 8. A lift cord 34 controls the raising and lowering of the blind assembly in a conventional manner.

The ladder illustrated is of the so called "string" type, the vertical legs 28,28 being braided cords and the cross pieces or rungs 26 being a plurality of unbraided filaments. The ladder is commercially available and is sized, cut and stapled for a given blind assembly. The legs are secured at their lower terminal end to the bottom rail by a button 29 which also anchors the pull cord and at their upper ends are fastened together by a staple 31. As illustrated, the legs are looped around the tilt control rod 32.

Figure 5:
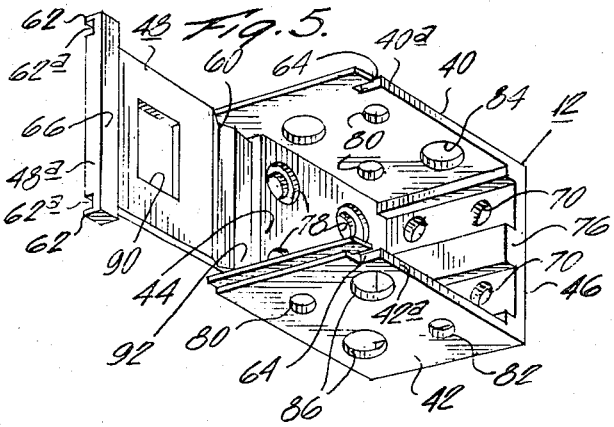
FIG. 5 is a perspective view thereof.
Figure 2:
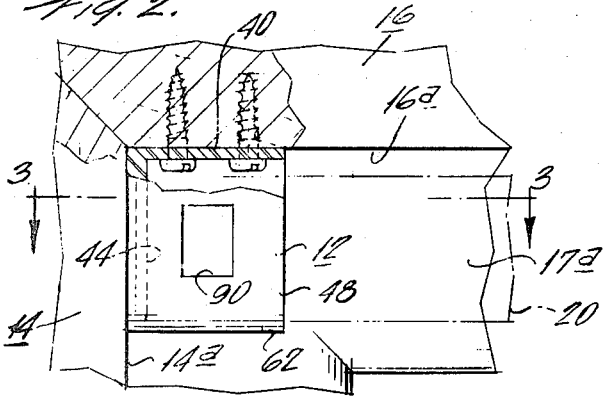
FIG. 2 is an enlarged fragmentary view with parts broken away to shown the universal bracket secured to the top wall of the window opening.
Figure 4:
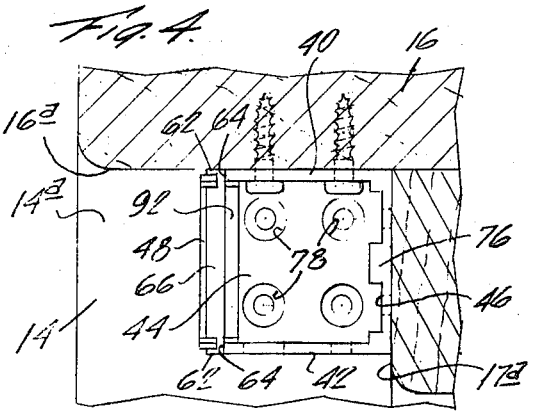
FIG. 4 is an end elevational view of the universal mounting bracket of the present invention.
Figures 6, 7:
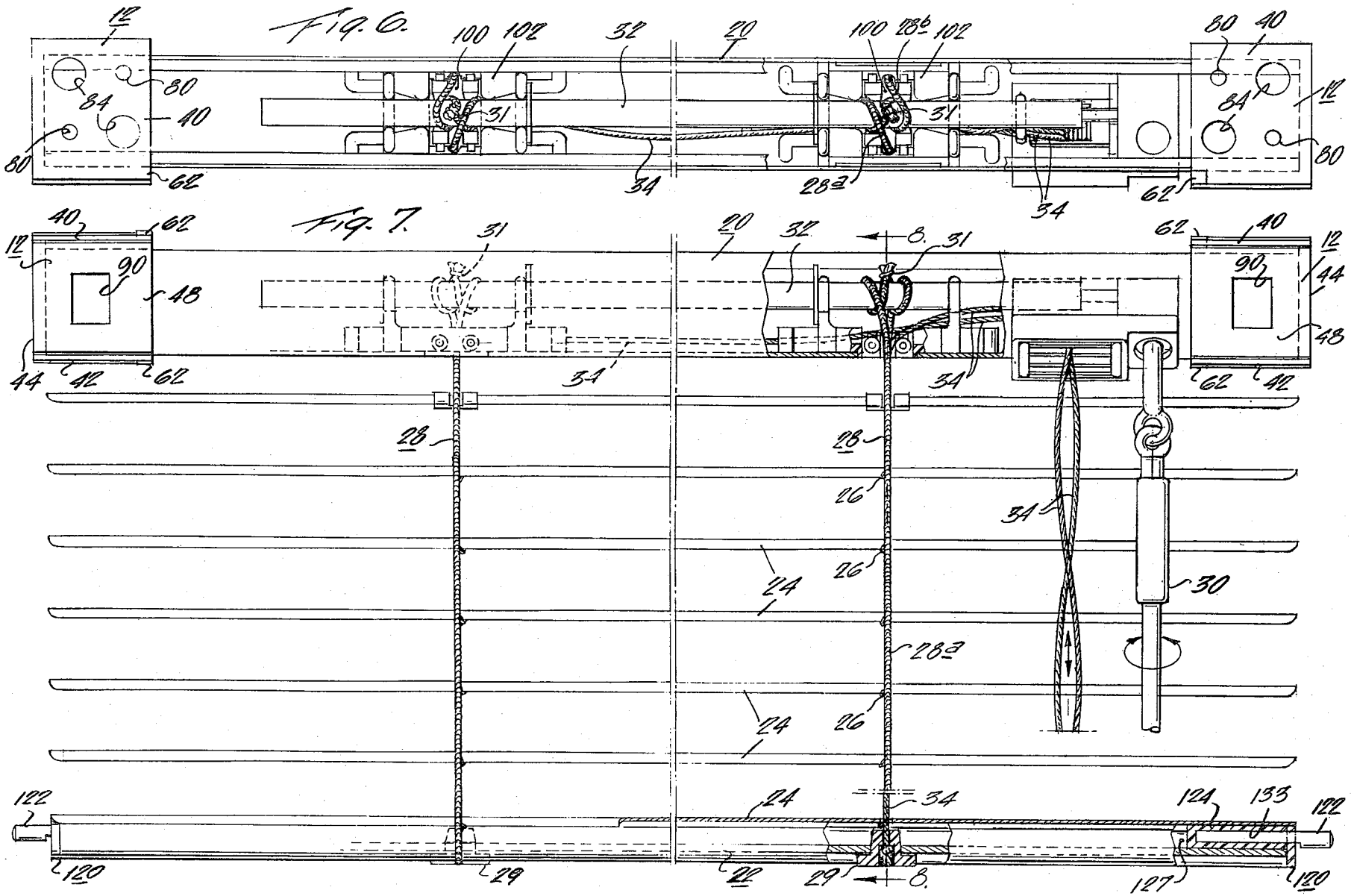
FIG. 6 is a sectional plan view taken on lines 6—6 of FIG. 1.
FIG. 7 is an enlarged front elevational view of the blind assembly with parts broken away to show the internal construction more clearly.

The universal mounting bracket 12 of the present invention as best illustrated in FIG. 5 is of generally box-like configuration and comprises spaced confronting generally rectangular top and bottom panels 40, 42, an end panel 44 connecting the long side edges of the top and bottom panels, a rear panel 46 integrally formed along the short side edges of the side panels and a pivotally mounted front closure panel 48 forming as illustrated an extension of the end panel 44 operable between an open position (FIG. 5) to permit insertion of the head rail into the bracket and a closed locked position confining the head rail in the pocket in the manner shown in FIGS. 6 and 7. The front closure panel 48 is scored at two spaced parallel locations 58 and 60, to define side by side hinges, the hinges 58 permitting pivotal displacement of the closure panel 48 to a position wherein locking tabs 62 are located forwardly of the front edges 40*a* and 42*a* of the top and bottom panels to align the tabs 62 with keeper slots 64. In this position, the forward edge 48*a* of the closure panel may be pressed rearwardly to engage the locking tabs 62 in the keeper slots 64. The hinge 60 allows rearward displacement to lock the assembly. The front edge of the closure panel 48 is of increased cross section defining an inwardly projecting rigidifying bar or rib 66 stabilizing the panel to provide for accurate registry of the tabs 62 and keeper slots 64. The tabs 62 which are an extension of the rib 66 are formed with grooves 62*a* providing a more snug fit and tight locking engagement in the keeper slots and locate the face of the closure panel essentially flush with the end edges of the top and bottom panels providing a more pleasing appearance. Note by reason of the side pivot arrangement of the front panel, the same bracket can be used at each end of the head rail to provide the same side pivot action at each end. Note also by this arrangement the load of the head rail does not act in a direction tending to displace the front panel to an open position.

As illustrated the panels 40, 42, 44 and 46 are provided with a series of openings to receive conventional screw fasteners to mount the bracket to the support surfaces of the window casement. The rear panel 46 has a series of four openings 70 arranged in pairs on opposite sides of a center strengthening rib 76. Screw fasteners are applied through these openings when it is desired to mount the bracket on the support surface 17*a*. When the bracket is mounted in this fashion, the front panel 48 is open to provide unobstructed access for turning screws with a convevtional screwdriver. The end panel 44 likewise has a series of four openings 78 and these, of course, are accessible through the open front end to mount the bracket on a vertical side support surface 14*a* of the window casement. The top and bottom panels 40, 42 have pairs of small holes 80, 82 for screw fasteners on a diagonal and larger access holes 84, 86 on an opposing diagonal. The opening and hole pattern of the top panel is a mirror image of the bottom panel so that the access holes in one panel align with fastener openings in the other. This arrangement permits insertion of a screwdriver through the larger holes to drive the screw fastener when mounting the bracket on the horizontal supporting surface 16*a* of the horizontal frame element 16. By reason of this construction the brackets are interchangeable at each end of the head rail.

The universal mounting bracket of the present invention facilitates assembly of the venetian blind in a window opening in an easy and quick manner as follows: Depending on the construction of the window frame, two mounting brackets are fastened either to the side 14*a*, top 16*a* or ledge 17*a* supporting surfaces in a manner described above with the open end of the brackets facing one another longitudinally and the unlocked front panels in an open position and facing forwardly. The head rail 20 is then simply positioned with its terminal ends in the open pocket of the brackets and the front closure panel pivoted about the hinges to a position where the tabs align with the keeper slots. The front panel is pressed rearwardly towards the end panel to lock it in place. Removal of the venetian blind assembly is also very simple.

The central opening 90 in the front panel provides a finger grip to press the front panel forwardly to disengage the tabs from the keeper slots so that the front panel can be pivoted open about its hinges 58 and 60. If the small bridge wall 92 between the hinges is accessible, digital pressure at this location produces the same unlocking action. Note the large pocket volume of the brackets allows flush corner mounting even if the head rail is slightly shorter than the distance between the end panels of the mounted brackets.

Another feature of the present invention is the provision of means for securing the slat ladder 28 to the tilt control bar 32 in such a manner as to permit the bar to continue to be rotated even after the slats have been tilted to one or the other limit position. Specifically, the slat ladder strings are wrapped two and one-half turns about the tilt control rod. The weight of the slats and bottom rail causes the strings to engage the tilt control rod with sufficient friction as to afford tilting of the slats when the control rod is rotated. This structure permits overdriving of the tilt control rod and eliminates the need for stops and the like. It also provides an arrangement which is economical to manufacture and easy to assembly. Note the small staple 31 securing the upper ends of the strings **28*a*, 28*d*** provides an economical attachment means and one that does not interfere with the interaction of the loop around the control rod effecting opening and closing of the blind on rotation of the rod or the tight closed attitude of the slats in the extreme limit position.

The tilt control rod 32 is of a predetermined small diameter so that when the ladder strings depend vertically in the fully closed blind position (broken lines in FIG. 8) all the slats including those at the top are at the same angular attitude. Note the slot 100 in the bearing block 102 for the tilt control rod is a full width opening to permit unobstructed lateral displacement of the ladder strings 28 to achieve uniform angular pivoting of the slats.

The diameter of the tilt control rod 32 is preferably ½" or less so that the inner and outer ladder strings **28*a*, 28*b* in either extreme closed limit position lie in parallel, vertical planes $P_1$ and $P_2$ tangent to the control rod 32. This relationship may also be described as follows. The slats 24** as illustrated are crowned and in the optimum closed position, the tangent $T_1$ of each slat face adjacent one longitudinal side edge lies in the plane $P_2$ and the point of tangency $T_1$ and the vertical projection of the other longitudinal side edge of each slat define a base $B_1$ approximately equal to the rod diameter.

Another feature of the present invention is the provision of anchoring means securing the bottom rail of the blind assembly and restraining swinging movement of the blind on movable installation such as doors. The anchoring means essentially comprises a plug insert 120 at each end of the bottom rail which mounts a pin 122 engageable by a pair of J-hooks projecting from the support surface at the lower end of the window opening. The insert 120 which may be made of plastic has a tongue portion 124 of inverted T-shaped cross-section the arms 126 engaging in opposing side channels 127 formed by flanges 128. Small flexible ribs 129 on the upper face of the arms 126 feathered at their forward edge as at 131 permit easy assembly of the insert and a sufficient frictional fit to support it in place. The insert 120 has an end wall 130 which abuts the end of the bottom rail and conforms generally to its cross-section. The insert thus provides a pleasing architectural finish for the bottom rail. Pins 122 which engage under J-hooks are mounted in key slots 133 in the insert 120.

Figure 10:
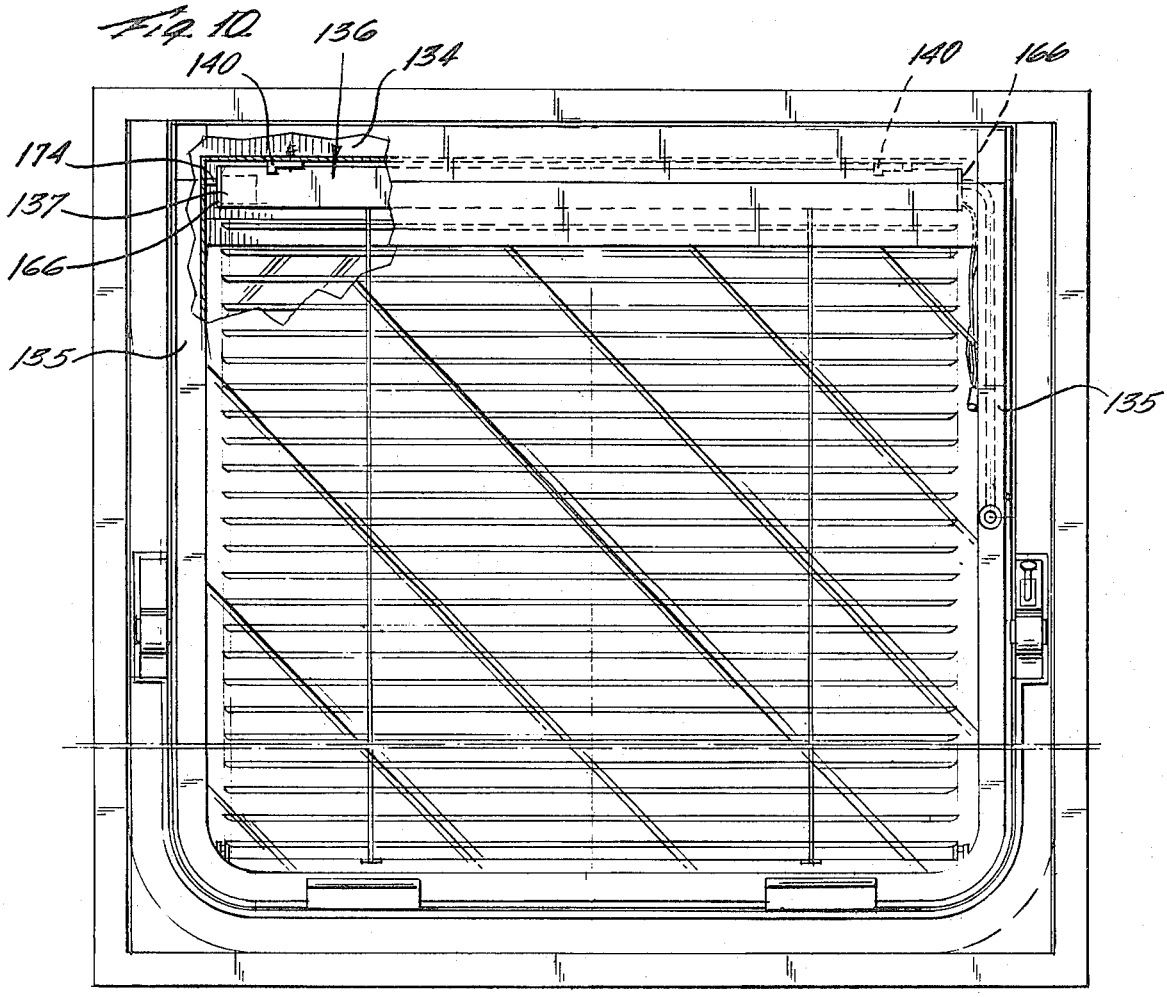
FIG. 10 is a front elevational view of a venetian blind assembly in accordance with the present invention installed in a conventional double pane window assembly.

There is illustrated in FIG. 10 a double glazed window assembly of generally conventional construction including a venetian blind supported in the space between the panes constructed in accordance with the present invention. The window assembly includes an outer frame made of metal suitably supported in an opening in a structural wall and a pivotally mounted sash including a top section or header 134, a pair of spaced parallel upright sides 135, 135 and a horizontal bottom section parallel to the header. A venetian blind 136 generally similar in overall arrangement to that described previously and including a head rail 137 of generally U-shaped cross-section, is detachably secured to the header 134 by brackets 140 of the present invention.

The mounting bracket for supporting the head rail as best illustrated in FIGS. 11–14 inclusive comprises a generally triangular base 142 adapted to be mounted flush against the sash header by means of a single screw fastener 144 allow rotational movement of the bracket and a pair of flexible locking legs 146 depending from the base, each having an outwardly directed tine or tang 148 to engage under downwardly and inwardly diverging ribs 150 running the length of the inner side walls of the rail 137. A locating rib 152 depends from one side edge of the base 142 which has an extended projection 154 remote from the tang and a shorter rib 156 defining a small groove or channel 158 which receives the upper edge of the head rail in the locked position. Each tine 148 has a tapered side face 160 which diverges downwardly and inwardly to a pointed tip 162 and a shoulder 163. The tapered side face complements the ribs 150 on the head rail to produce a camming action and inward deflection of the legs 146 upon initial assembly of the head rail. When the head rail is fully seated the legs flex outwardly and the shoulders 163 engage under the ribs 150 to lock the head rail in place. The head rail may disassembled from the brackets when desired or necessary by simply engaging the projection 154 and pivoting the bracket forward to the broken line position shown in FIG. 12. This pivoting rotates the legs to a position disengaging the shoulders from the rib to release the blind assembly. Note the legs are staggered relative to the pivot axis A—A to effect release action by rotation of the bracket through a very small angular turn. In the present instance, the inner side edges of the legs and the pivot axis A—A lie in a common plane $P_4$.

Figure 11:
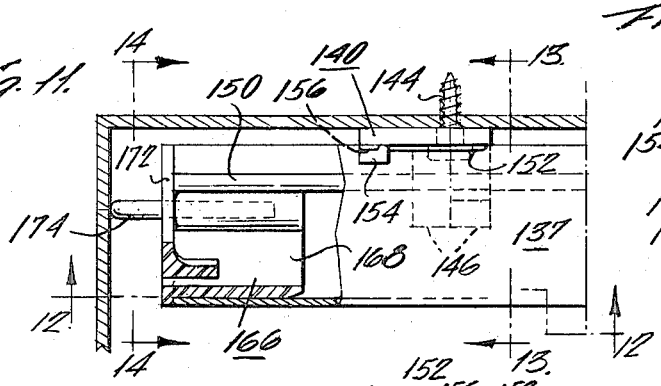
FIG. 11 is a fragmentary sectional view showing the head rail lateral positioning means of the blind assembly.
Figure 13:
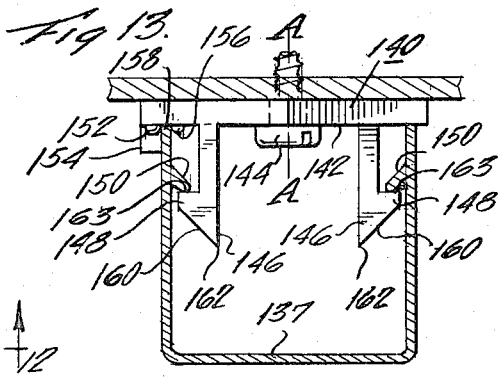
FIGS. 13 and 14 are sectional views taken on lines 13—13 and 14—14 respectively of FIG. 11.
Figure 12:
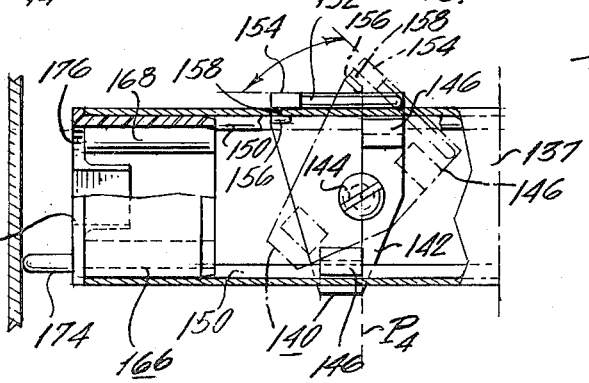
FIG. 12 is a sectional view taken on lines 12—12 of FIG. 11 showing the mounting bracket in a locking position (solid lines) and in a release position (broken lines)
Figure 14:
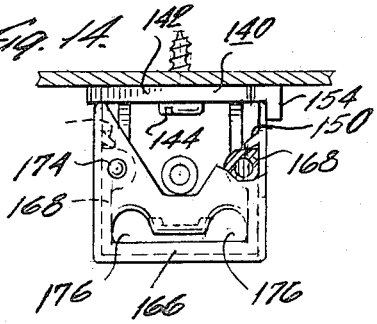

The head rail assembly also mounts a combination thrust bumper and end cap, the details of which are best illustrated in FIGS. 11, 12, and 14. This member is preferably made of a low friction plastic material and comprises a body portion 166 of generally U-shaped cross section sized relative to the head rail to mount therein with a slight interference fit, with upstanding sides 168 engaging under the rail ribs 150. The end flange 172 mounts a pin 174 abutting the side frame of the sash to centrally locate the blind and also to prevent lateral displacement of the head rail and blind during actuation of the pull cord to raise and lower the slats. The end flange 172 has a pair of corner channels 176 separating the cords to prevent entanglement. The channels also present a low friction surface at the 90° juncture of the cords which eliminates the problem of fraying on sharp edges of the metal head rail and prolongs the life of the assembly.

We claim:

1. A bracket for mounting the head rail of a venetian blind to a support surface of a window opening said head rail being in the form of channel member of U-shaped cross section comprising a base member pivotally mounted to a support surface, a pair of flexible, resilient legs depending from the base member having tangs at their terminal ends engageable with locking beads running the length of the head rail channel and rotatable to a position wherein said tangs release said channel member, the outer terminal portions of said tangs being spaced apart a distance greater than the spacing between said locking beads whereby upon assembly of said bracket means, said legs flex inwardly toward one another upon engagement of said tangs with said beads and then flex outwardly to engage said tangs under said beads.

2. A bracket as claimed in claim 1 wherein each tang has a tapered side face which converges downwardly and inwardly to a pointed tip at its outer terminal free end and a shoulder spaced upwardly from the tip end, the side face complementing the ribs on the head rail to produce a camming action and inward deflection of said legs upon assembly of the head rail to the bracket, said shoulders engaging under the rib when the head rail is fully seated to lock the head rail in place.

3. A bracket as claimed in claim 1 including a locating rib depending from one side edge of the base of the bracket having an extended projection remote from the tang and a shorter rib defining a channel within which the upper edge of the head rail seats in the locked position.

4. A bracket as claimed in claim 1 wherein the legs are staggered relative to the pivot axis of the bracket to effect release action by rotation of the bracket through a small angular turn.

5. A bracket as claimed in claim 1 wherein the inner side edges of the legs and the pivot axis lie in a common plane.

6. A bracket as claimed in claim 4 wherein said legs are disposed on opposite sides of a plane through the pivot axis to permit release by turning said bracket through a small angle.

7. Mounting means as claimed in claim 4 including a combined bumper and locating element supported in one end of said head rail engageable with a surface transverse to the support surface to center the blind in the window opening and prevent lateral displacement of said head rail toward said transverse surface during opening and closing of the blind assembly.

* * * * *